United States Patent [19]

Fukuhara

[11] 4,099,391

[45] Jul. 11, 1978

[54] LATCH KNITTING NEEDLE AND METHOD OF MAKING SAME

[75] Inventor: Masao Fukuhara, Nishimuro, Japan

[73] Assignee: Fukuhara Needle Co., Ltd., Wakayama, Japan

[21] Appl. No.: 852,785

[22] Filed: Nov. 18, 1977

[30] Foreign Application Priority Data

Jul. 6, 1977 [JP] Japan ..... 52-81176

[51] Int. Cl.[2] ..... D04B 35/04

[52] U.S. Cl. ..... 66/121

[58] Field of Search ..... 66/121, 122, 123

[56] References Cited

U.S. PATENT DOCUMENTS

| | | | |
|---|---|---|---|
| 3,031,867 | 5/1962 | Wiederhut et al. | 66/121 |
| 3,145,550 | 8/1964 | Bennett | 66/121 |

FOREIGN PATENT DOCUMENTS

| | | | |
|---|---|---|---|
| 1,928,241 | 12/1969 | Fed. Rep. of Germany | 66/121 |

*Primary Examiner*—Ronald Feldbaum

*Attorney, Agent, or Firm*—Nathan Levin

[57] ABSTRACT

A pivoted latch needle having a concave shaped seat formed in the stem portion thereof to receive therein the spoon end of the latch when the latter is moved to its opened position, the shape of the surface of the seat conforming to the curvature of the exterior surface of an arcuate section of a right circular cone the axis of which extends lengthwise of the needle, the curvatures of the surface of the convex side of the spoon end of the latch and of the surface of the seat being similar so that there is surface to surface contact therebetween, and a method of forming the seat by the use of an end milling cutter of cone shape to remove predetermined material from the stem of the needle.

6 Claims, 16 Drawing Figures

( PRIOR ART )

Figure 1:
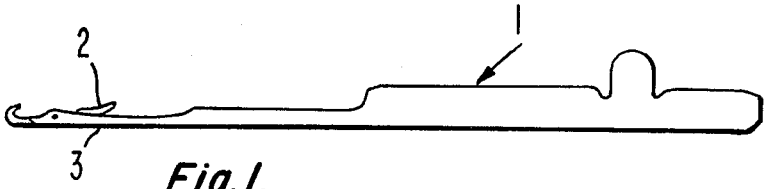
Fig. 1. (PRIOR ART)

Fig.8.
(PRIOR ART)
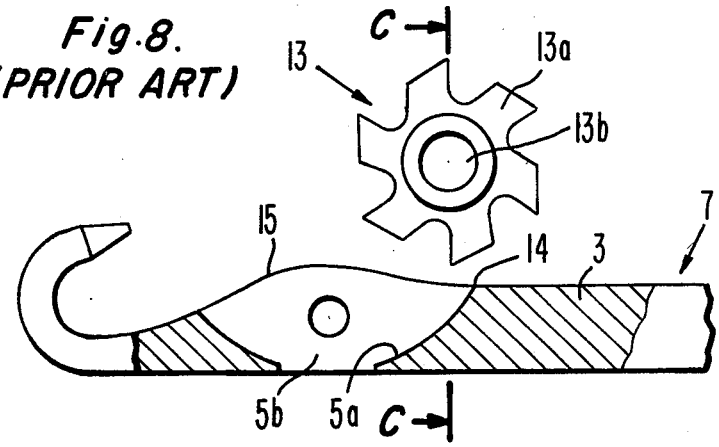
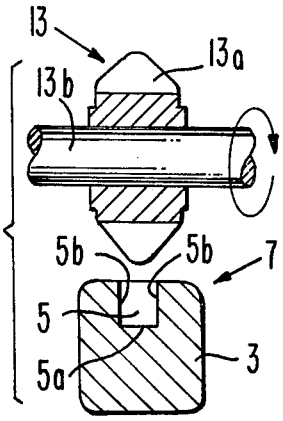
Fig.9.
(PRIOR ART)
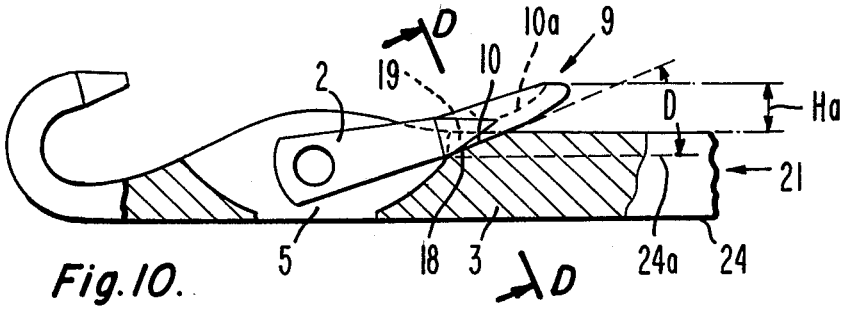
Fig.10.
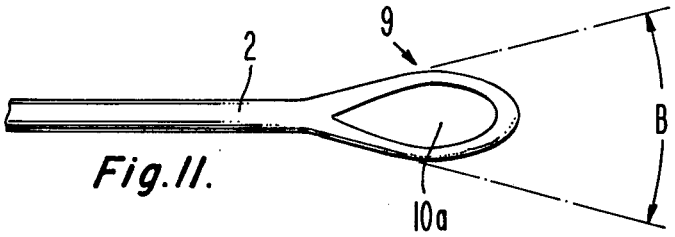
Fig.11.
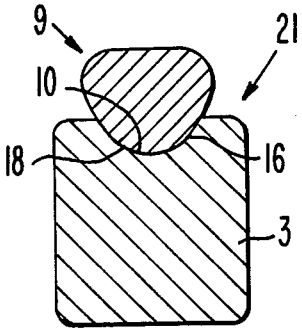
Fig.12.
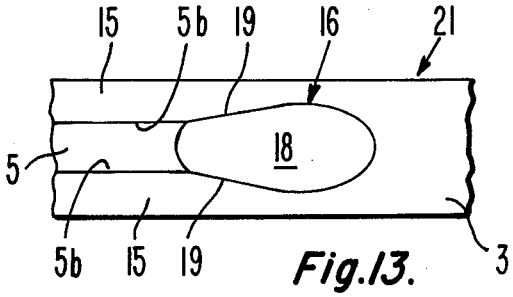
Fig.13.

LATCH KNITTING NEEDLE AND METHOD OF MAKING SAME

The present invention relates generally to the art of knitting and more particularly to pivotted latch needles wherein an improvement is provided in the shape of the seat for the spoon end of the latch of the needle, and to a method of making the same.

With the advent and the use of higher speed finer guage multi-feed circular knitting machines having steeper cam angles for reciprocating the latch needles, the latter are caused to travel at higher linear speeds with the result that their latches are caused to oscillate faster, and, since the greater part of the mass of the latches is concentrated at the spoon ends thereof, it follows that the latches are whipped back and forth with considerably increased centrifugal forces acting thereon, such forces being alternately exerted against the hooks and the stems of the needles as the latches are repeatedly caused to strike the hooks and the stems during the faster opening and closing of the latches. Further, since finer guage needles, of relatively fragile construction, of minimum dimensions and of closer tolerances, are used in such higher speed machines, the dissipation of such increased centrifugal forces acting upon the hooks and the stems of the needles, particularly when the spoon ends of the latches strike the stems of the needles, often causes such deformation and damage to the latches, the latch seats and to the stems of the needles as to render the latter unfit for use.

While some specially formed seats for the latches of pivotted latch needles are known, it is the principal object of the present invention to provide an improved seat for the latches of pivotted latch needles which will minimize damage thereto during the use of such needles, and to provide an improved method of making the same.

It is also an object of the present invention to provide an improved seat for the spoon ends of the latches of pivotted latch needles wherein the shape of the seat conforms to the shape of an arcuate segment of the exterior surface of a right circular cone, and to the method of using a cone shaped end milling cutter to form the seat in the stem portion of the needles.

With the above and other objects in view which will become apparent from the following description of a preferred embodient of the invention shown in the accompanying drawings, the present invention resides in the inproved latch seat and method of making the same as illustrated and as pointed out in the claims.

Figure 2:
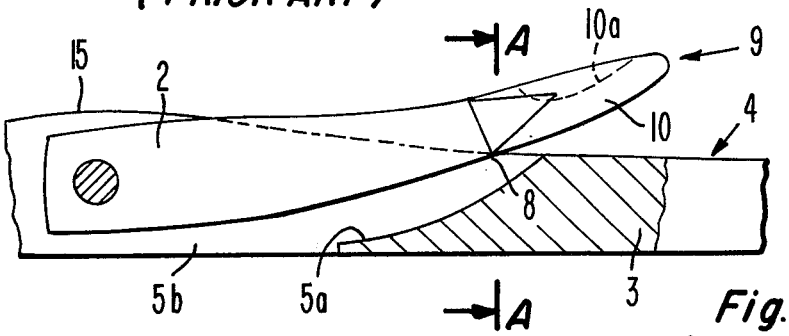
Fig. 2. (PRIOR ART)
Figure 4:
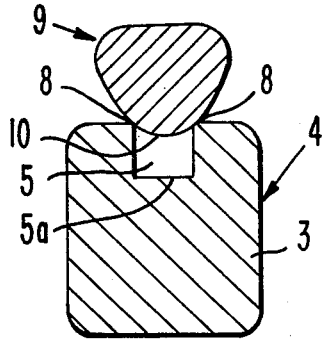
Fig. 4. (PRIOR ART)
Figure 3:
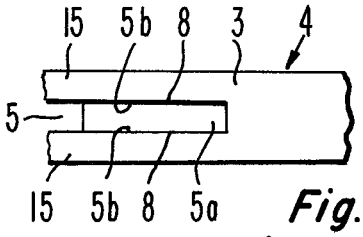
Fig. 3. (PRIOR ART)
Figure 5:
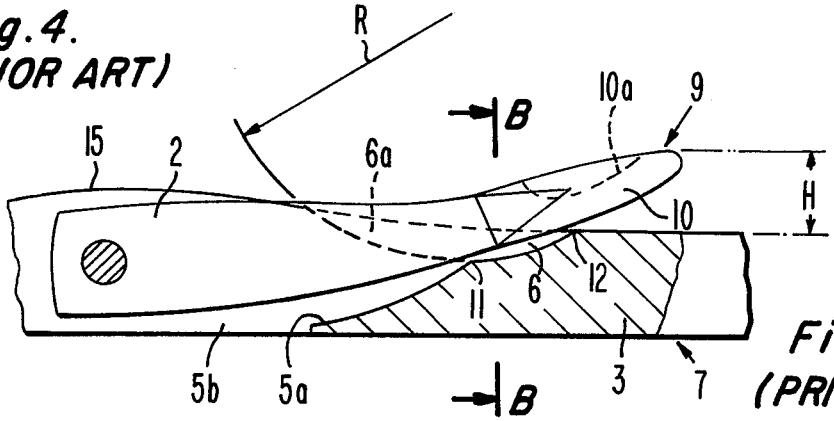
Fig. 5. (PRIOR ART)
Figure 7:
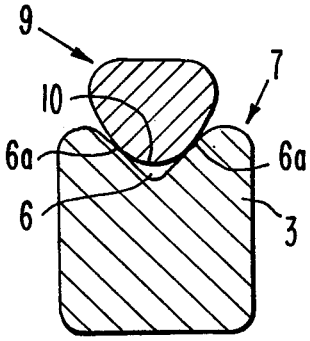
Fig. 7. (PRIOR ART)
Figure 6:
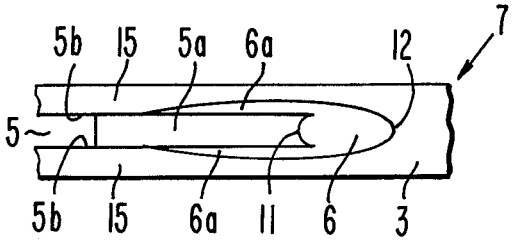
Fig. 6. (PRIOR ART)
Figure 14:
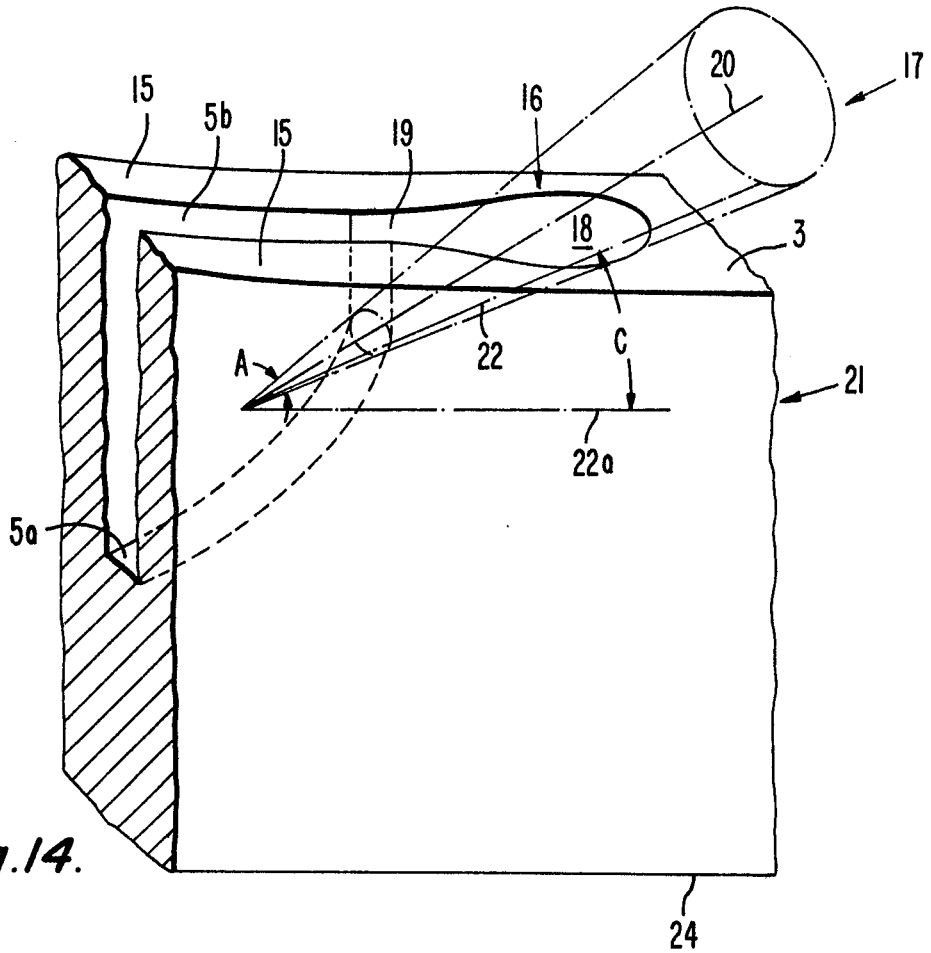
Figure 15:
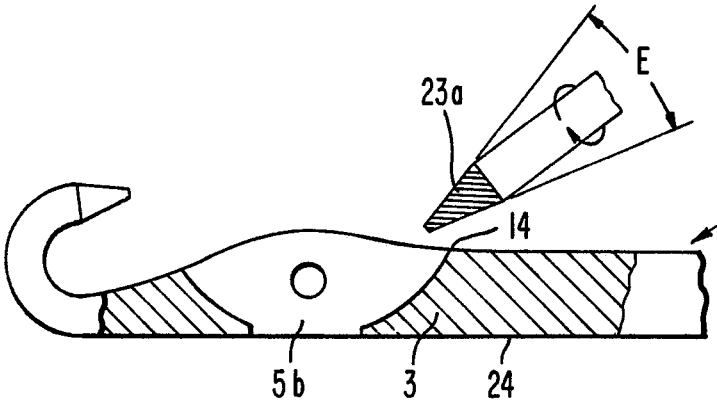
Figure 16:
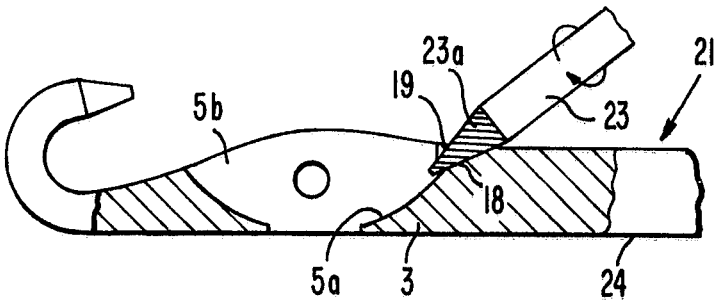

In the drawings:

FIG. 1 is a side view of a pivotted latch needle of the prior art,

FIG. 2 is an enlarged side view, partly in section, of a portion of a prior art latch needle wherein no provision has been made for a seat, as such, for the latch of the needle, FIG. 3 is a plan view of a portion of the needle shown in FIG. 2 with the latch omitted, FIG. 4 is an enlarged sectional view of FIG. 2 as taken on line A—A thereof, FIG. 5 is a view generally similar to FIG. 2 but wherein provision has been made, according to the prior art, for a seat for the latch of the needle, FIG. 6 is a plan view of a portion of the needle shown in FIG. 5 with the latch omitted, FIG. 7 is an enlarged sectional view of FIG. 5 as taken on line B—B thereof, FIG. 8 is a side view, partly in section, of the hook end of a conventional latch needle, with the latch omitted, prior to the formation therein of the latch seat of FIG. 5, and of a circular milling cutter used to form the seat, FIG. 9 is a sectional view of FIG. 8 as taken on line C—C thereof, FIG. 10 is an enlarged side view, partly in section, of the hook end of a latch needle wherein provision has been made, according to the present invention, for an improved seat for the latch of the needle, FIG. 11 is an enlarged plan view of the spoon end of the latch of FIG. 10, FIG. 12 is an enlarged sectional view of FIG. 10 as taken on line D—D thereof, FIG. 13 is a plan view of a portion of the needle shown in FIG. 10 with the latch omitted, FIG. 14 is a greatly enlarged perspective view of a portion of the needle stem of FIG. 10 showing therein the shape of the improved latch seat of the present invention, FIG. 15 is a view generally similar to FIG. 10 with the latch omitted and prior to the formation therein of the latch seat of the present invention, and of a cone-shaped end milling cutter used to form the seat, and FIG. 16 is a view generally similar to FIG. 15 with the end mill cutter positioned within the opening formed by it in the stem of the needle, in accordance with the present invention.

In FIGS. 1 through 9 the construction of certain prior art pivotted latch needles is shown. The construction of one such needle is shown in FIGS. 2, 3 and 4 in a needle 4 wherein no provision has been made for a seat, as such, for the spoon end of the latch. A second such needle is shown in FIGS. 5 through 9 in a needle 7 wherein provision has been made for a seat for the spoon end of the latch. Another latch needle construction wherein provision has been made for a seat for the spoon end of the latch is shown in U.S. Pat. No. 3,031,867 wherein the material itself of the needle has been displaced to form the seat. In the prior art of FIGS. 1 through 9 and in the present invention of FIGS. 10 through 16, like reference characters have been used to designate like parts.

Conventional latch needles, as at 1 in FIG. 1, are each provided with a pivotted latch 2 which is caused, by each of a succession of knitted stitches, to repeatedly move back and forth about a pivot, between its opened position of FIG. 1 wherein the spoon end of the latch comes to rest upon stem portion 3 of the needle, and its closed position (not shown) wherein the spoon end of the latch comes to rest upon and covers the hook of the needle.

In FIGS. 2, 3 and 4, needle 4 having a widened cheek portion is provided therein with a lengthwise extending parallel sided slot 5 disposed midway between its side walls 15, 15. One end of the slot terminates in a curved face 5*a* formed in stem 3 of the needle. The side faces are indicated at 5*b*, 5*b*. Latch 2, having a generally oval-shaped spoon 9 at the free end thereof, is pivotally mounted in the slot. The spoon, which is literally 'sppon-shaped', is provided with a convex shaped outer face 10 and a corresponding concave shaped inner face 10*a*, shown in dotted lines. When the latch is in its opened position, FIG. 2, the neck end of the outer face of the spoon is in contact with and rests upon the linear extending corners of the side walls at points 8, 8 along the same. Such contact between spoon and side walls is essentially point contact between straight lines and a convex shaped surface.

While the construction of FIGS. 2, 3 and 4 is generally satisfactory for the relatively coarse guage latch needles used in the relatively slower speed circular knitting machines having the relatively lower cam angles for moving the needles, it is not satisfactory for the fine guage needles used in the aforesaid higher speed circular knitting machines having the steeper cam angles for moving the needles. It is not satisfactory because repeated striking, under the higher impact forces generated in such higher speed machine, between face 10 of spoon 9 and the corners of side walls 15, 15 at points 8, 8, results in deformation and breakage of such parts of the needles, particularly of the latches, with the result that the needles are unfit for further use. Further, the corners of the side walls become rounded with the result that the latches, in opened position, are undesirably close to the needle stem.

Another prior art construction of latch needles is shown in needle 7 in FIGS. 5 through 9 wherein the needle is provided with a latch seat of special shape. The shape of the seat is defined by an arc-shaped segment of a generally V-shaped circular groove formed in and extending lengthwise of the stem and of the adjoining portion of the latch slot of the needle. The groove forms cut out portion 6 in the stem and adjoining spaced cut out portions *6a, 6a* in faces *5b, 5b* of side walls 15, 15 of the needle, the bottom face of cut out 6 extending from point 12 and intersecting slot face *5a* along curved line 11. As in FIGS. 8, 9, a circular milling cutter 13, having V-shaped teeth *13a*, and rotating with shaft *13b*, may be used to form the aforesaid groove in the needles. The rotating cutter is moved downwardly from its position in FIG. 8 above rear end 14 of the slot for a predetermined distance, thereby removing material from the needle to form the aforesaid cut outs therein. Obviously, cutter 13 and the groove both have the same radius R of FIG. 5. As in FIGS. 5 and 7, spoon face 10 of the latch rests upon the V-shaped faces of cut outs *6a, 6a*, in spaced relation to points 11, 12. Contact between the V-shaped faces and face 10 is essentially point contact since it is between flat planes and a common convex shaped surface. The axis of cutter 13 extends normal to the planes of faces *5b, 5b* of slot 5. The needle parts are so formed, FIG. 5, that the opened latch is initially positioned to have a suitable distance H between the end of the opened latch and the stem 3 of the needle for satisfactory stitch formation. However, when such needles are of the fine guage used in the aforesaid higher speed circular knitting machines, the continued striking, under the higher impact forces generated in such higher speed machines, between face 10 of spoon 9 and the faces of cut outs *6a, 6a* causes the contacting parts of such faces to become worn with use. This causes an unsatisfactory decrease in the distance H, and when the contacting parts are worn to such an extent that spoon face 10 strikes one or both points 11, 12 of the stem, the whipping action of the high speed opening and closing of the latches results in deformation and breakage of the latches with the result that the needles are rendered unfit for further use. The decrease in the distance H also results in unsatisfactory knitting.

The improved latch seat of the present invention, and a novel method of making the same, are shown in FIGS. 10 through 16 in a needle 21 wherein the improved latch seat of novel configuration is indicated at 16. A cone shaped milling cutter 23, FIGS. 15, 16, having a cutting end *23a* of right circular cone shape, is used to form the seat with the result that the shape of the seat conforms to the shape of the external surface of the cutter. As the turning cutter 23 is moved downwardly from its position of FIG. 15, above end 14 of slot 5, to its position of FIG. 16, it removes the corresponding portion of the needle stem to provide the seat 16 with a cone shaped face 18 and with a pair of flat surfaces extending from one end thereof. Shape 18 corresponds to the shape of an arcuate portion of the outer surface of a right circular cone. FIG. 14 shows seat 16 in the stem of needle 21 with a right circular cone 17, in phantom lines and greatly enlarged, in the seat. Cone 17 is representative of the outer face of cone end *23a* of cutter 23. Angle A of cone 17 is equal to angle E of cone *23a*, these angles being measured in a plane extending diametrically through the axes of the cones, the axis of cone 17 being shown at 20 in FIG. 14. Angle B of the neck end of spoon 9 of latch 2, FIG. 11, is substantially equal to the equal angles A of FIG. 14 and E of FIG. 15. Central axis 20 of cone 17 (and the central axis of cone *23a* when the seat is formed) is located in a plane extending parallel to and midway between faces *5b, 5b* of slot 5. Angle C between face of cone 17 along line 22 thereof (which represents the deepest part of face 18 in seat 16) and line *22a* (which is parallel to back 24 of the needle) is equal to angle D, FIG. 10, between the convex face of spoon 9 and line *24a* which is parallel to back 24 of the needle.

It will be noted that a minimum amount of the needle material is removed to form seat 16 in comparison to the amount of needle material removed in the prior art modification of FIGS. 5 through 9, and wherein the cut outs *6a, 6a* weaken the side walls of the slot 5.

Contact between the seat of the present invention and the spoon of the needle is between surfaces of similar curvature, that is, between concave face 18 in the seat and convex face 10 of the spoon, FIG. 12, and which provides face to face contact therebetween. Consequently, the higher centrifugal force, expended by the latch as it is whipped to opened position, in the aforesaid higher speed machines, is distributed over and is absorbed by the entire area of surface 18 of seat 16, with the result that there is a minimum of wear between these surfaces and consequently a minimum of deformation and breakage of the latches, as a result of which the needles of the present invention are longer lasting. Further, since there is a minimum of wear between the seat and the latch spoon, distance Ha, FIG. 10, remains substantially unchanged for continued satisfactory stitch formation.

Present day fine guage needles are relatively fragile, as above noted, and are not easy to manufacture on a mass production basis, so that much care is needed to see that there is a minimum of defective needle rejects while, at the same time, producing needles which are stronger and which are longer lasting. The present method of manufacture, and the resulting needle, is superior to the method and the needle of FIGS. 5 through 9 wherein the side walls of the latch slot are considerably weakened. With resoect to the method and the needle of the aforesaid U.S. Pat. No. 3,031,867 wherein pressure from a press die acting on both sides of the latch slot causes displacement of the stem material into the slot, such action often causes the stem itself to bulge outwardly or to be spread laterally with the result that the needle is undesirably wider than desired where the displacement takes place. Further, the surface of a latch spoon seat resulting from displacement of the stem material is not the equal in uniformity and smoothness of a machined surface as results from the use of the cone shaped end mill of the present invention. It will be noted that the axis 20 of the cone 17 extends at an acute angle to the stem 3 of the needle.

I claim:

1. In a pivotted latch needle having a stem portion, a slot formed in said stem portion, a latch pivotally disposed in said slot for oscillating movement between its opened and closed positions, the said latch having a spoon-shaped end thereof, an improved seat in said needle to receive said spoon-shaped end of said latch therein when the latter is in its said opened position, said seat comprising a concave-shaped recess formed in said stem portion, the shape of the surface of said recess conforming to the shape of the exterior surface of an arcuate section of a right circular cone the axis of which is in a plane extending lengthwise of said slot.

2. In a latch needle as in claim 1 wherein said slot is parallel sided and wherein said plane is parallel to and midway between said sides of said slot.

3. In a latch needle as in claim 2 wherein said spoon-shaped end of said latch has a convex-shaped surface and wherein said last named surface is in surface-to-surface contact with said surface of said recess when said latch is in its said opened position.

4. In a latch needle as in claim 3 wherein said surface of said recess is a machined surface.

5. In a latch needle as in claim 2 wherein said axis of said cone extends at an acute angle to said stem of said needle.

6. In a latch needle as in claim 2 wherein said recess is formed by a cone-shaped end mill acting upon and removing a predetermined amount of material from said stem portion of said needle.

* * * * *